US007107713B2

(12) United States Patent
Simson et al.

(10) Patent No.: US 7,107,713 B2
(45) Date of Patent: Sep. 19, 2006

(54) ADJUSTABLE SIGN SUPPORT

(76) Inventors: Anton K. Simson, 1350 Shinley Pl., Escondido, CA (US) 92026; Dan C. Pulos, 8573 Canoga Ave., Canoga Park, CA (US) 91304

( * ) Notice: Subject to any disclaimer, the term of this patent is extended or adjusted under 35 U.S.C. 154(b) by 0 days.

(21) Appl. No.: 11/186,093

(22) Filed: Jul. 20, 2005

(65) Prior Publication Data

US 2006/0010741 A1 Jan. 19, 2006

Related U.S. Application Data

(62) Division of application No. 10/356,371, filed on Jan. 31, 2003, now abandoned.

(60) Provisional application No. 60/353,876, filed on Feb. 2, 2002.

(51) Int. Cl.
*G09F 7/20* (2006.01)
*G09F 15/00* (2006.01)

(52) U.S. Cl. ..... 40/606.13; 40/611.01; 40/607.13; 40/610

(58) Field of Classification Search ..... 40/490, 40/491, 492, 606.13, 606.14, 611.01, 611.02, 40/606.15, 624, 739, 741, 607.13, 607.15, 40/610, 612; 248/279.1, 285.1, 286.1, 434, 248/435, 448
See application file for complete search history.

(56) References Cited

U.S. PATENT DOCUMENTS 1,184,246 A * 5/1916 Klein ..... 248/448
1,818,717 A * 8/1931 Kliegl ..... 248/448
2,101,500 A * 12/1937 Jagus ..... 40/606.13
2,882,641 A * 4/1959 Young ..... 248/448

* cited by examiner

*Primary Examiner*—Brian K. Green
(74) *Attorney, Agent, or Firm*—Charmasson, Buchaca & Leach, LLP

(57) ABSTRACT

An adjustable support structure for temporary sign displays formed from a vertically oriented rigid panel having a plurality of length and angle adjustable support arms. Each arm has a distal end thumb screw attachment to a T-nut on the sign. The arm is adjustably anchored to the panel by a bolt extending from the panel through a longitudinal oval slot in the arm to engage a wingnut. Additional hardware prevents loss of movable parts. Sign stiffening battens are tethered to the panel. A stiffening tray parallely spaced apart from the back of the panel further bears against and secures the support arms.

3 Claims, 4 Drawing Sheets

ADJUSTABLE SIGN SUPPORT

PRIOR APPLICATION

This application is a divisional of U.S. patent application Ser. No. 10/356,371 filed Jan. 31, 2003 now abandoned, which claims the benefit of U.S. provisional application No. 60/353,876 filed Feb. 2, 2002.

FIELD OF THE INVENTION

This invention relates to signs and advertising displays and more particularly to adjustable mechanisms for mounting temporary advertising signs.

BACKGROUND OF THE INVENTION

Referring now to FIG. 1, fast food restaurants have long employed permanent outdoor order stands 1 typically having back-lighted displays 2 indicating various items for sale and their prices in combination with a microphone and speaker assembly 3 for taking orders from customers. Periodically, fast food restaurants have found it advantageous to run limited duration promotional campaigns for new products, prize give-aways or other items of marketing interest to their customers. The promotional campaigns often include the display of temporary signs 4 carrying information about the campaign. It is useful to display such temporary signs in prominent locations where customers will have frequent view of them. One such high customer traffic area is the order stand. Typically, the sign is supported atop the stand using a holder 5 formed by a vertical rigid panel 6 attached along an orthogonal base 7. The panel has a number of screw holes 8 for allowing the temporary attachment of the sign thereto.

There are drawbacks to this type of existing sign support device. First, the frequently used large, bulky or odd-shaped signs are not adequately supported for wind and other weather occurrences which may bend the sign at its extremities. Further, the deployment and taking-down of the sign is a time consuming process requiring an adequate level of skill to properly align holes in the sign with holes on the panel. Sometimes, holes must be drilled through the sign on site during deployment and located according to available holes in the panel, leading to potentially unsightly placement of fasteners which interfere with the content of the sign. For example, if the sign content displayed an image of a human model, a fastener might appear on the nose of the model, or on some other, more distracting location. Lastly, fastener hardware such as nuts and bolts often become lost or misplaced between the frequent change-overs of the signs.

Existing temporary signs are typically made from a pair of semi-rigid plastic sheets sandwiching a reinforcing corrugated plastic structure between.

SUMMARY OF THE INVENTION

The principal and secondary objects of this invention are to provide a mounting system for temporary signage in association with a permanent structure which provides for adjustability and adequate support of various shaped signs, which provides for easy attachment and detachment, and which discourages the loss or misplacement of fastening hardware.

These and other objects are achieved by providing a support panel having a plurality of length and angle adjustable support arms having the attachment hardware permanently attached thereto and tethered sign stiffening battens.

DESCRIPTION OF THE PREFERRED EMBODIMENT OF THE INVENTION

Figure 1:
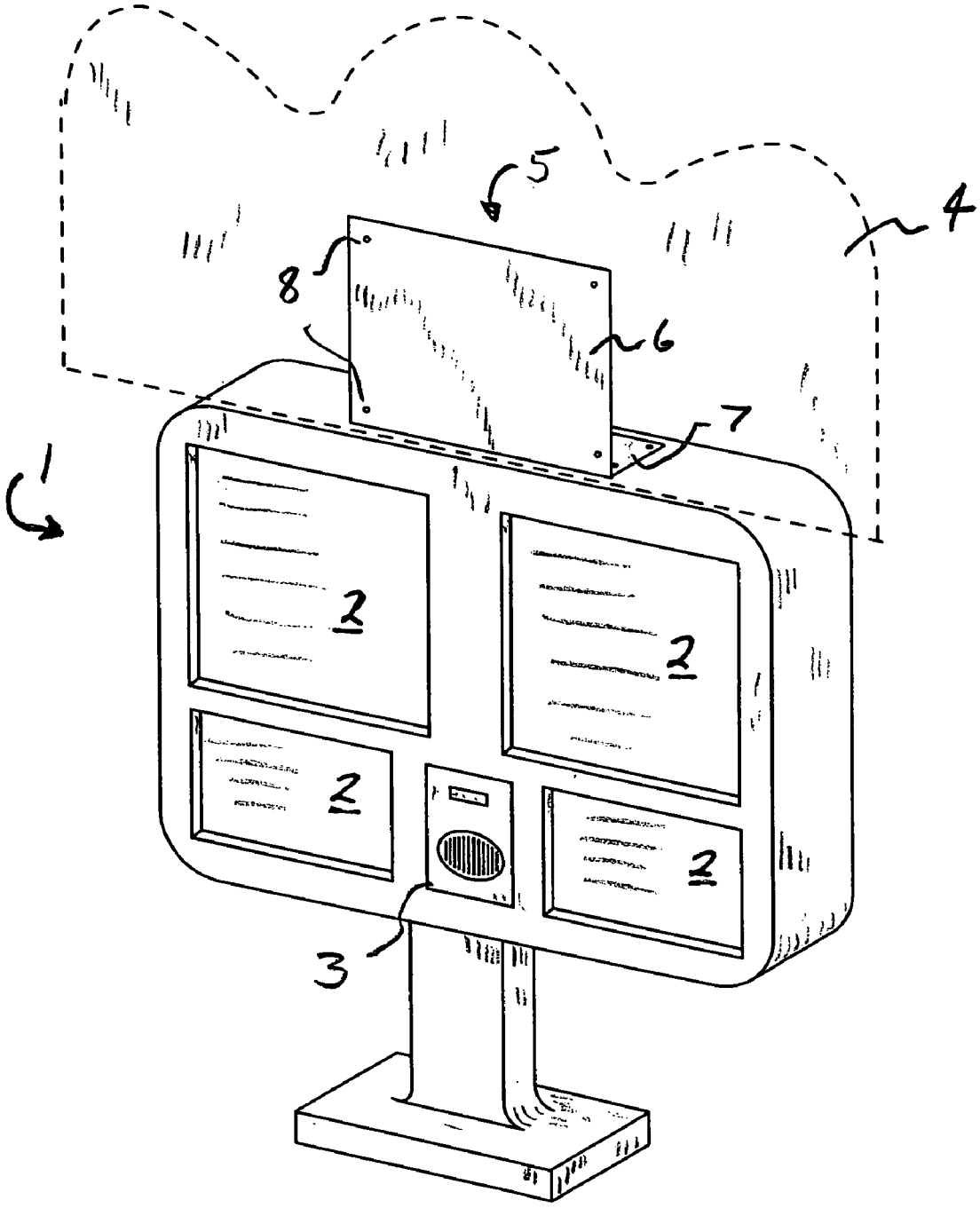
FIG 1 PRIOR ART
FIG. 1 is a prior art diagrammatic perspective view of a display and stand combination.
Figures 2, 8:
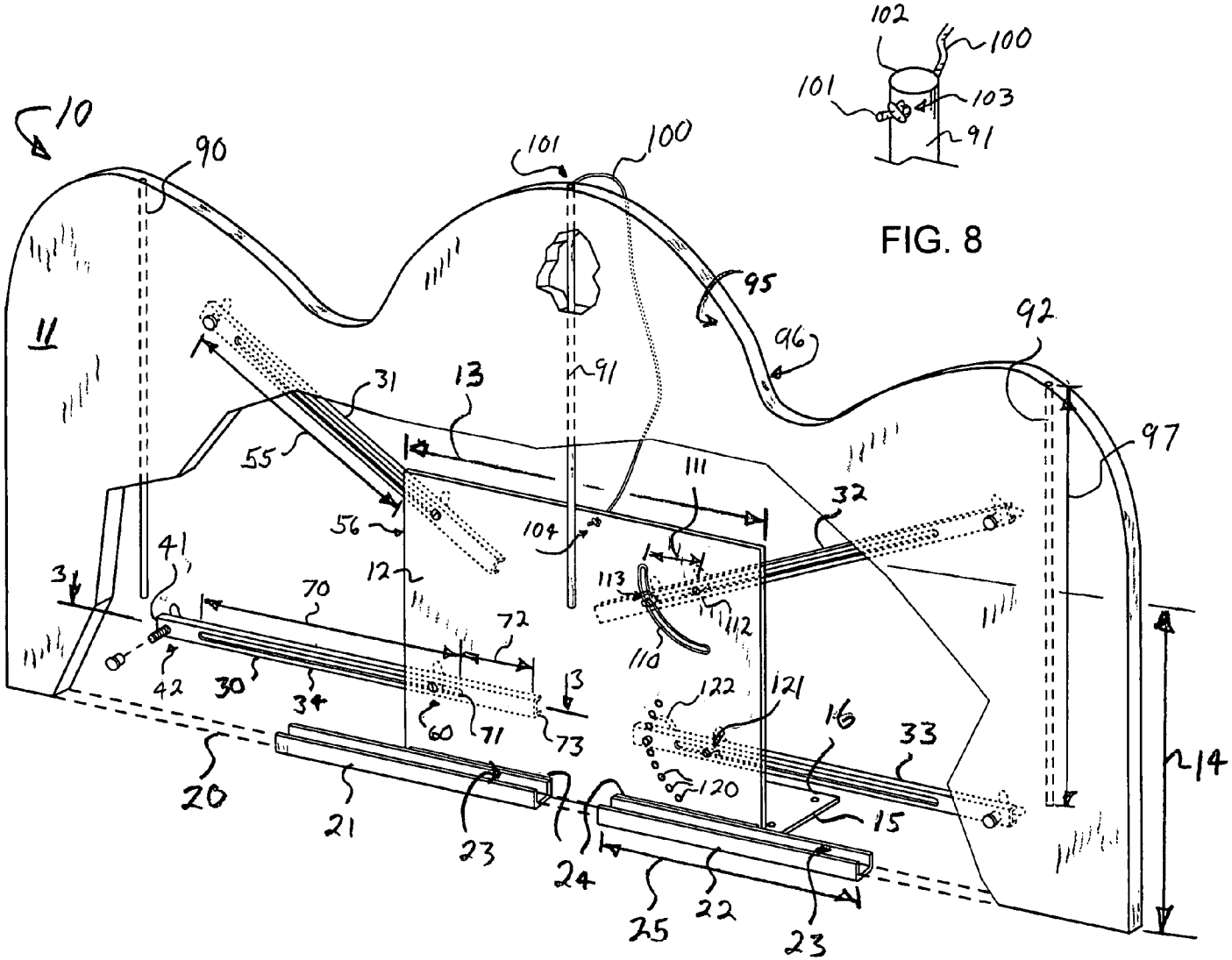
FIG. 2 is a diagrammatic perspective view of a first embodiment of a holder according to the invention for temporarily supporting a sign.
FIG. 8 is an enlarged diagrammatic partial perspective view of an end of a rigidizing batten according to the invention.

Referring now to the drawing, there is shown in FIG. 2, a holder 10 for supporting a temporary sign 11. The holder has a substantially vertically oriented rigid planar panel 12 made from durable rigid sheet material such as rolled stainless steel, and in the present embodiment having a width dimension 13 of about 30 inches, a height dimension 14 of about 15 inches and a thickness of about 1/16 inch. Extending rearwardly and orthogonally from a bottom edge of the panel is a base 15 which is fastenable through mounting holes 16 to the top of a stand or other fixed structure.

The holder further employs means for supporting and rigidizing the sign. First, the sign is first supported along its lower edge 20 by a pair of retaining ledge members 21,22. Each ledge member is formed to have an elongated generally U-shaped body turned upwardly so as to provide a top channel 23 sized and shaped to accept the lower edge of the sign therein. The ledge members are attached to the front surface of the panel near its bottom edge using a layer of double-sided sticky tape 24. The length 25 of each ledge member is preferably at least one half the width dimension of the panel and most preferably about 24 inches in the present embodiment.

Figure 3:
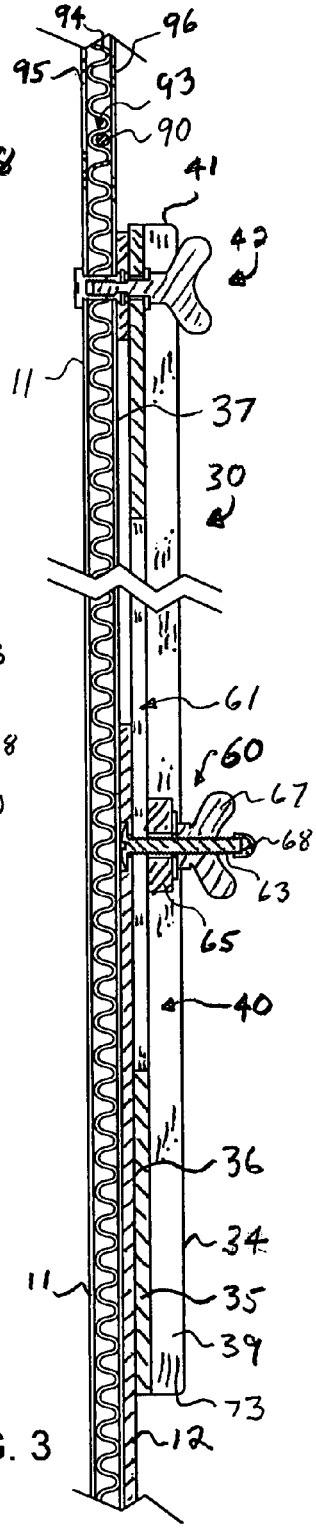
FIG. 3 is a diagrammatic cross-sectional view of a support arm taken along line 3—3.
Figure 4:
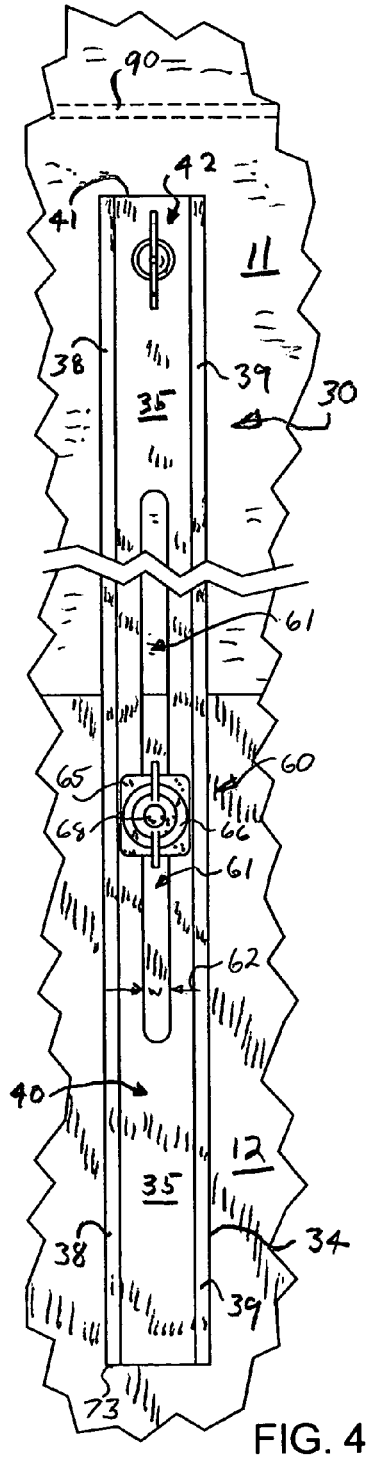
FIG. 4 is a diagrammatic back plan view of the support arm of FIG. 3.

Referring now to FIGS. 2–4, further means for adjustably supporting the sign are provided by a plurality of length adjustable and angularly adjustable support arms 30,31,32, 33. Each arm comprises a generally elongated body 34 made from rigid, durable material such as stainless steel formed to have a flattened base portion 35 for resting against the planar back surfaces 36,37 of the panel and sign. Rigidizing flanges 38,39 extend rearwardly from the opposite lateral edges of the base portion creating a central valley 40. The body may also be formed as an aluminum extrusion.

Figure 5:
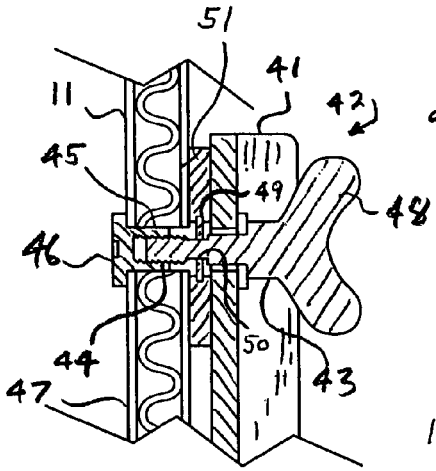
FIG. 5 is an enlarged diagrammatic cross-sectional view of the distal end fastener of the support arm of FIG. 3.

As shown in FIG. 5, the body of the support arm has a first distal end 41 upon which is mounted a fastening assembly 42 having a pin 43 having an anterior threaded portion 44 adapted to penetrate through a hole 45 in the sign 11 to engage a T-nut or button nut 46 having an anterior widened head portion for bearing against the front surface 47 of the sign. The pin is actuated by thumb-screw wings 48 to releasably fasten to the button nut and hence the sign. The pin is permanently but rotatively attached to the arm using a snap ring 49 which radially engages a cylindrical groove 50 in the pin posterior to the threading. Optionally, a spacer 51 integrated with the snap ring, is selected to adjust for the thickness of the support panel thereby providing a planar bearing for the sign. Alternately, the thickness of the snap ring can be selected to provide this function.

Referring back to FIG. 2, in this way, a support arm 31 can provide support a greater distance 55 away from the periphery 56 of the panel to discourage bending of the panel in the wind.

Figure 6:
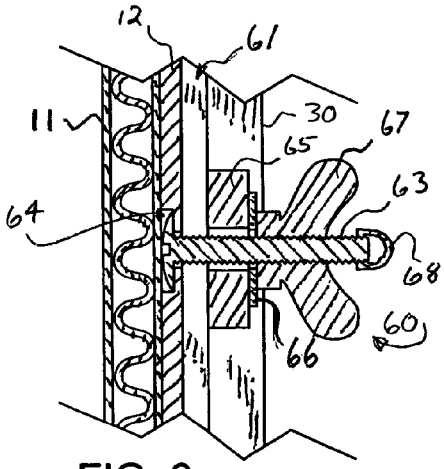
FIG. 6 is an enlarged diagrammatic cross-sectional view of the sliding and pivoting anchorment of the support arm of FIG. 3.

Referring now to FIGS. 3,4, and 6, each support arm 30 is adjustably mounted to the panel 12 at a sliding and pivoting anchorment 60. The arm has a medial elongated oval slot 61 penetrating front-to-back through the base portion 35 or the arm body. The slot is elongated along the major axis of the body. The width 62 of the slot is selected to allow penetration of a mounting screw carriage bolt 63 therethrough. The bolt extends from a recessed hole 64 in the front surface of the panel through the slot 61 and through a generally quadrangular nylon slider 65 and protective washer 66. The slider is sized to rest within the valley of the body. When tightened, a wingnut 67 releasably anchors the arm to the panel in a fixed angular and sliding orientation. An acorn nut 68 prevents unscrewing the wingnut from the bolt to reduce lost parts.

Referring back to FIG. 2, the axial length 70 and location of the slot is selected to maximize adjustability of the sliding movement of the arm while maintaining adequate leverage against rearward movement of the arm's distal end 41. Therefore, the proximal end of the slot 71 terminates a distance 72 from the proximal end of the arm 73, thereby forming what amounts to a flattened extension to provide additional leverage support and rigidity for the positioning of the arm by bearing against the back surface of the panel. Preferably, the distance will be at least ⅙ the length of the slot, and more preferably at least ¼ the length of the slot. Those skilled in the art will appreciate that the dimensions of the above described features should be selected to avoid interference between two or more arms.

Figure 7:
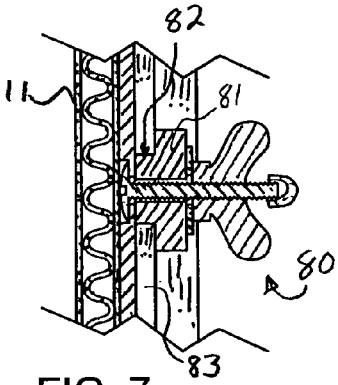
FIG. 7 is an enlarged diagrammatic cross-sectional view of an alternate embodiment of the sliding and pivoting anchorment.

As shown in FIG. 7, an alternate embodiment of the sliding and pivoting anchorment 80 provides greater stability through a slider 81 having a prominence 82 sized to closely engage the slot 83.

The above description reveals that the arms can be adjusted to provide support using holes in the sign predrilled at preferred, content-unobtrusive locations.

Referring to FIGS. 2–4 and 8, further sign rigidizing means are provided by a plurality of battens 90,91,92 in the form of cylindrical rods made from strong rigid material such as steel. Each rod is sized and shaped to penetrate through a pre-existing corrugation channel 93 formed between the undulating inner sheet 94 and either the front sheet 95 or back sheet of the sign 96. Most preferably, a channel formed with the back sheet is selected to avoid a possible unsightly bulge on the front of the sign. The rods preferably have a length 97 which will be short enough to remain hidden once the battens are in place, but long enough to provide stiffening across the weakest points of the sign and to locate at least a portion 98 of the rod near to the panel or support arm such as a distance of not more than ⅓ the length of the rod. In the present embodiment the battens are preferably as long as the major dimension of the shortest support arm.

Referring now to FIGS. 2 and 8, means for preventing loss of a batten 91 comprise a tether 100 having a first end 101 anchored to a top end 102 of the batten by passing through a hole 103 and terminating in a knot. The opposite end 104 of the tether attaches similarly to the panel 12.

Referring back to FIG. 2, there is shown an alternate embodiment of an adjustable support arm 32 wherein an arcuate aperture 110 bordered by a recessed flange is cut through the panel along an angular track a fixed radial distance 111 from the pivot point 112. A second adjustable tightening screw 113 through the arm slot and having a wing-nut tightening means further stabilizes the positioning of the pin within the aperture.

Also shown in FIG. 2 is a second alternate embodiment of an adjustable support arm 33 wherein a series of holes 120 through the panel are formed in an arc along an angular track a fixed radial distance from the pivot point 121. A spring loaded bolt 122 is sized to penetrate through one of the holes to provide additional angular and sliding stabilization to the arm. Of course such support is only provided at fixed positions. The bolt may remain retracted at other orientations.

Figure 9:
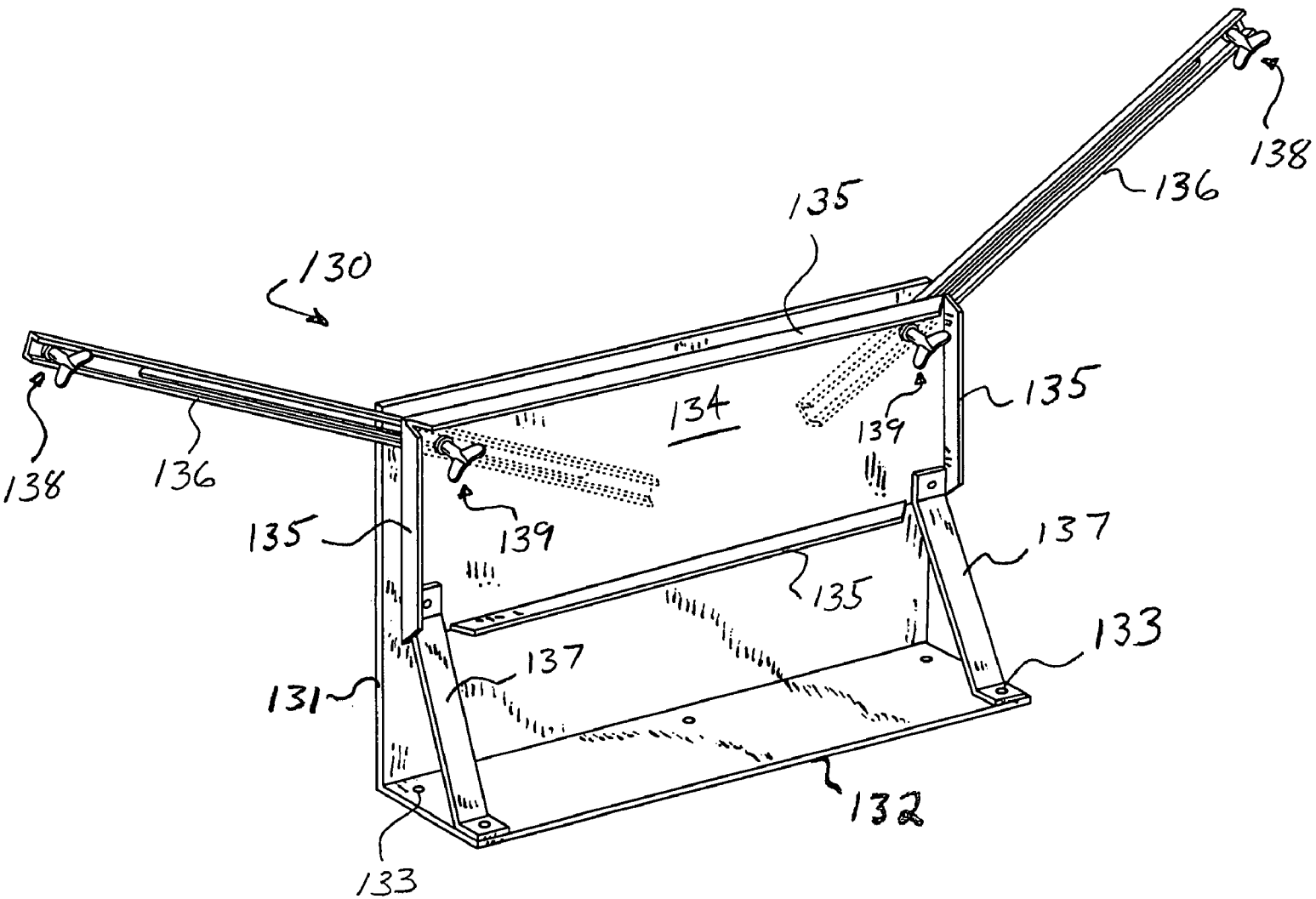
FIG. 9 is a diagrammatic perspective view of an alternate embodiment of a holder according to the invention having front and back panels sandwiching the support arms.

Referring now to FIG. 9, there is shown a holder 130 according to an alternate embodiment of the invention. Similarly to the prior embodiment, the holder has a substantially vertically oriented rigid planar front panel 131 made from durable rigid sheet material, and a base 132 extending rearwardly and orthogonally from a bottom edge of the panel which is fastenable to a fixed structure through mounting holes 133. The holder also has a substantially vertically oriented rigid planar rear panel or tray 134 made from durable rigid sheet material. Rigidizing flanges 135 extend rearwardly from the peripheral edges of the tray to provide further rigidization. The front and rear panels are parallelly spaced apart to allow positioning of one or more support arms 136 therebetween. Angled braces 137 further support the rear panel and bond to the base 132 to minimize interference with movement of the arms. Similarly to the prior embodiment, each support arm 136 has a fastening assembly 138 mounted near its distal end, and a sliding and pivoting anchorment 139 to allow adjustment and securement of each arm. The sandwiching action of the front and rear panels provide bearing surfaces to pinch against corresponding front and back surfaces of the support arm further securing the arms in place and serving to stiffen and strengthen the entire holder. While the preferred embodiments of the invention have been described, modifications can be made and other embodiments may be devised without departing from the spirit of the invention and the scope of the appended claims.

What is claimed is:

1. A sign holder comprises:

a substantially vertically oriented panel;

a substantially vertically oriented tray spaced apart from said panel;

a first rigid and oblong support arm having a major axis, a proximal end, and an opposite distal end;

said arm being pivotably and slidingly attached to said panel; and, a fastener attached to said distal end for attaching to a sign having peripheral edges, at a location spaced apart from said peripheral edges;

wherein said tray has a first surface bearing against said first support arm;

wherein said holder further comprises means for adjusting a first distance between said distal end and said panel;

wherein said means for adjusting comprise:

an axially oblong slot penetrating through said first support arm; and a tightenable bolt passing through said slot and engaging said panel, whereby said bolt, when tightened, fixes an orientation of said arm with respect to said panel.

2. The holder of claim 1, wherein said bolt forms a pivot point between said arm and said panel.

3. A sign holder comprises:

a substantially vertically oriented panel;

a substantially vertically oriented tray spaced apart from said panel;

a first rigid and oblong support arm having a major axis, a proximal end, and an opposite distal end;

said arm being pivotably and slidingly attached to said panel; and, a fastener attached to said distal end for attaching to a sign having peripheral edges, at a location spaced apart from said peripheral edges;

wherein said tray has a first surface bearing against said first support arm; and, wherein said tray and said panel pinch said first support arm therebetween.

* * * * *